United States Patent [19]

Zinnbauer

[11] Patent Number: 4,721,403

[45] Date of Patent: Jan. 26, 1988

[54] TWO-PIECE SOLID DEODORANT DISPENSING PACKAGE WITH HINGED COVER

[75] Inventor: Gerald B. Zinnbauer, Bay Village, Ohio

[73] Assignee: Owens-Illinois Closure Inc., Toledo, Ohio

[21] Appl. No.: 929,562

[22] Filed: Nov. 12, 1986

[51] Int. Cl.[4] ..... B43K 21/00

[52] U.S. Cl. ..... 401/82; 401/06

[58] Field of Search ..... 401/82

[56] References Cited

U.S. PATENT DOCUMENTS

| | | | |
|---|---|---|---|
| 1,611,937 | 12/1926 | Nelson | 401/82 |
| 1,731,721 | 10/1929 | McGowan | 401/82 |
| 3,061,084 | 10/1962 | Tibbitts | 401/82 X |

*Primary Examiner*—Gregory E. McNeill

*Attorney, Agent, or Firm*—H. G. Bruss

[57] ABSTRACT

A solid deodorant dispensing package that includes a container, a solid deodorant holding cup which is moveable in a cavity in the container between a dispensing position in which a portion of the solid deodorant extends through an opening in the container and a storage position in which such portion of the solid deodorant is entirely contained within the container, and a closure which is hingedly attached to the holding cup and which is formed integrally therewith. In one embodiment of the invention, the closure is a generally L-shaped member which is folded back approximately 180° through a partial depth opening in one of the sides of the container, to present one of the legs of such L-shaped closure member at a position where it can be readily grasped to permit the advance and the retraction of the holding cup within the cavity of the container. In another embodiment of the present invention, one of the sides of the container is provided with an opening through which a rib that is attached to the holding cup extends and in this embodiment of this invention the holding cup is provided with a flexible extension which extends upwardly therefrom, and which has a free end portion that is secured to the side of the container that has the opening therein, to form a self-opening and self-closing closure for the dispensing opening of the container.

21 Claims, 11 Drawing Figures

TWO-PIECE SOLID DEODORANT DISPENSING PACKAGE WITH HINGED COVER

CROSS-REFERENCE TO RELATED APPLICATION

This application is a continuation-in-part of my copending application Ser. No. 915,361, filed on Oct. 6, 1986 for a "Solid Deodorant Dispensing Package", the disclosure of which is hereby incorporated herein by reference.

BACKGROUND OF THE INVENTION

1. Field Of The Invention

This invention relates to a dispensing package for a solid deodorant. More particularly, this invention relates to a dispensing package for a solid deodorant which is made up of the solid deodorant, a container for the solid deodorant and a combined solid deodorant holding cup and container closure. The solid deodorant solid holding cup is movable with respect to the container to present the solid deodorant in a position for use or dispensing, and to thereafter retract the solid deodorant within the container to permit the closing of the container.

2. Description Of The Prior Art

Solid deodorants are now packaged in dispensing packages mainly in either an oval shape or a cylindrical or rodlike shape. In either such package type, the solid deodorant is elevated to a proper dispensing position, relative to a container element of the package, usually by a separate screw-type mechanism or occasionally by separate parts which slide relative to one another. In the case of a dispensing package that utilizes a screw-type or other elevating mechanism, the need for such an elevating mechanism increases the complexity of the package, and thereby decreases the reliability of its operation and increases the cost of its materials and assembly, and can lead to confusion in the use of the dispensing package by consumers who are not familiar with the operation of the elevating mechanism. Additionally, the use of a separate closure for closing such a solid deodorant dispensing package poses the risk that the closure and the container will become disassociated from one another during use, thereby leading to the possibility that it will not be possible to properly reclose the solid deodorant dispensing package after the use of the solid deodorant on one or more occasions, which is a nuisance to the consumer, especially when the consumer desires to pack the solid deodorant dispensing package for purposes of travel.

SUMMARY OF THE PRESENT INVENTION

According to the present invention there is provided a dispensing package for the packaging and dispensing of a solid deodorant in cake or generally parallelepiped form, the package being made up of such solid deodorant, a container therefor, and a combined solid deodorant holding cup and container closure for elevating the holding cup and the solid deodorant with respect to the container after or upon the opening of the container to present the solid deodorant for dispensing, and for retracting the solid deodorant within the container before or upon the closing of the container.

In a first embodiment of the present invention, there is provided a multiplicity of relatively thin walls that define a hollow, generally parallelepiped-shaped container with a dispensing opening along of one of its surfaces and a partial depth opening adjacent to the dispensing opening along a surface that adjoins the surface that has the dispensing opening. The bottom portion of the solid deodorant is contained within a generally parallelepiped-shaped cup that is moveable within the container toward and away from the dispensing opening, to selectively either withdraw the entirety of the solid deodorant within the outline of the container to permit the dispensing opening and the partial depth opening adjacent to the dispensing opening to be closed, or, alternatively, to advance a portion of the solid deodorant through the dispensing opening and beyond the outline of the container, after the opening of at least the dispensing opening, for access to the solid deodorant by a user.

The closure of the package of the first embodiment of the present invention is in the form of an L-shaped member, the free edge of the first of whose legs is hingedly attached to an edge of the cup adjacent the surface of the container that has the partial depth opening therein. Preferably, the cup and the L-shaped member are formed integrally with one another, and this may be readily and relatively inexpensively accomplished on a mass production basis by injection molding such combined cup and closure from a suitable thermoplastic material, such as high density polyethylene or modifications thereof, or polypropylene or modifications thereof, or flexible forms of polystyrene such as butadiene modified forms of polystyrene. In any case, the second leg of the L-shaped member, that is, the one that is not attached to the cup, extends across and closes the dispensing opening of the container when the closure is in the closing position, while, at the same time, the first leg extends normally from such second leg toward the edge of the cup to which it is attached to close the partial depth opening in the surface that adjoins the dispensing opening. To open the package, the closure is rotated approximately 180° with respect to the cup to bring the first leg of the L-shaped member into a position overlying and extending generally parallel to the wall of the cup to which it is hingedly attached, a portion of the wall of the container that has the partial depth opening therein lying between such wall of the cup and such first leg of the L-shaped member. In this position, the second leg of the L-shaped member, that is, the one that serves to close the dispensing opening when the L-shaped member is in its closing position, will project outwardly from the container and will permit the user to grasp such second leg to raise the cup within the container to present a portion of the solid deodorant beyond the outline of the container through the dispensing opening for access to the solid deodorant, and then to lower the cup within the container by grasping such second leg so that the container can be reclosed.

In the second embodiment of the present invention, there is provided a multiplicity of relatively thin walls that define a generally parallelepiped-shaped container with a dispensing opening along one of its surfaces, and an opening adjacent to the dispensing opening within a surface that adjoins the surface that has the dispensing opening. The bottom portion of the solid deodorant is contained within a generally parallelepiped-shaped cup that is moveable within the container toward and away from the dispensing opening, to selectively either withdraw the entirety of the solid deodorant within the outline of the container to permit the dispensing opening and the opening in the wall that is adjacent to the dispensing opening to be closed or, alternatively, by grasping a tab that projects outwardly from the cup through the opening in the wall that is adjacent to the dispensing opening, to advance the holding cup toward the dispensing opening and to thereby advance a portion of the solid deodorant through the dispensing opening and beyond the outline of the container for access to the solid deodorant by a user.

The holding cup of the second embodiment of the present invention has a tail portion which extends from the underside thereof, adjacent to the wall of the container that has the opening which is adjacent to the dispensing opening of the package. The tail that is attached to the underside of the holding cup has sufficient flexibility to permit it to be folded under when the holding cup is in its retracted, closed position within the container, and sufficient elasticity to resume a straight orientation that extends generally parallel to the path of travel of the holding cup within the container, thereby to serve to close the opening in the wall of the container that is adjacent to the dispensing opening, upon the advance of the holding cup within the container to the dispensing position of the package. The holding cup of this embodiment of the present invention also has a flexible portion attached to the open end thereof, which flexible portion is folded back upon itself so that it's free and is attached to the container at a location adjacent to the dispensing opening of the container. This flexible portion of the holding cup is configured to serve as a closure for the package when the holding cup is retracted within the container, and a portion of this flexible portion advances with the holding cup upon the opening of the package to a non-closing position, to permit ready access to the solid deodorant within the holding cup when the solid deodorant is in the dispensing position.

Accordingly, it is an object of the present invention to provide a new and improved solid deodorant dispensing package. It is a further object of the present invention to provide a solid deodorant dispensing package in which the dispensing of the solid deodorant can be accomplished without the need for a complex screw-type elevating mechanism. It is also an object of the present invention to provide a solid deodorant dispensing package in which the package is self closing upon the retraction of the solid deodorant within the container element of the package and which is self-opening upon the advance of the solid deodorant with respect to the container to present a portion of the solid deodorant at a location beyond the container for access by a user.

It is yet another object of the present invention to provide a solid deodorant dispensing package that is made up of separate container and combined deodorant holding cup and closure elements which can be satisfactorily mass-produced from relatively inexpensive thermoplastic materials by conventional molding processes and equipment.

It is also an object of the present invention to provide a solid deodorant dispensing package which, when displayed in the usual manner, presents a readily decoratable flat surface that is readily visible to a purchaser or a prospective purchaser.

For further understanding of the present invention and the objects thereof, attention is directed to the drawing and the brief description thereof, to the detailed description of the preferred embodiment and to the appended claims.

DETAILED DESCRIPTION OF THE PREFERRED EMBODIMENT

Figure 1:
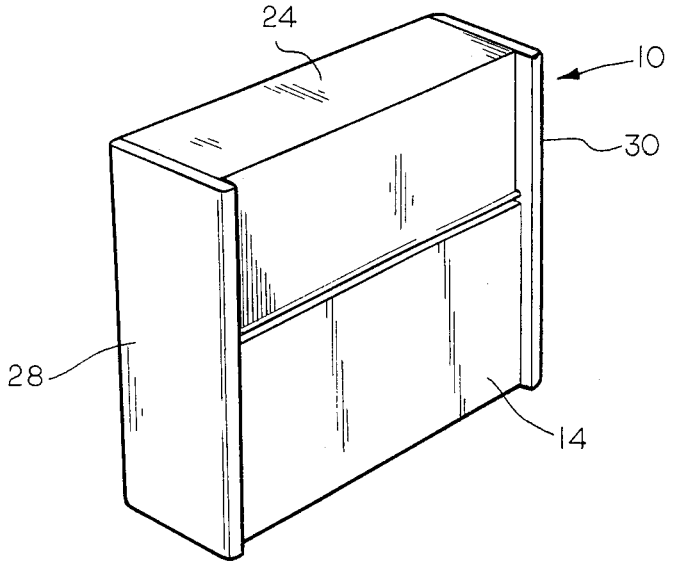
FIG. 1 is a perspective view of the preferred embodiment of a solid deodorant dispensing package according to the present invention in its closed form.
Figure 2:
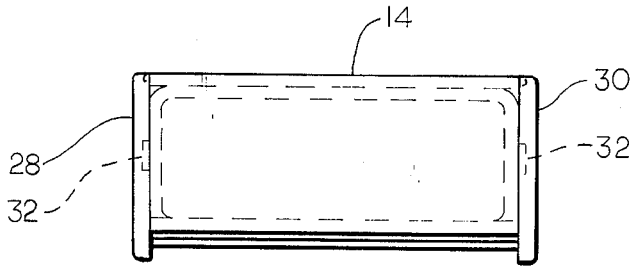
FIG. 2 is a top plan view of the solid deodorant dispensing package of FIG. 1.
Figure 3:
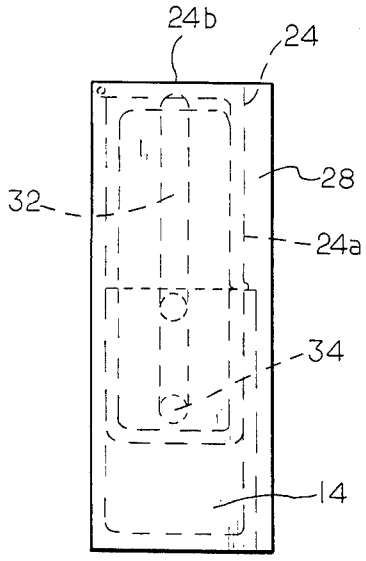
FIG. 3 is a side elevational view of the solid deodorant dispensing package of FIGS. 1 and 2.
Figure 4:
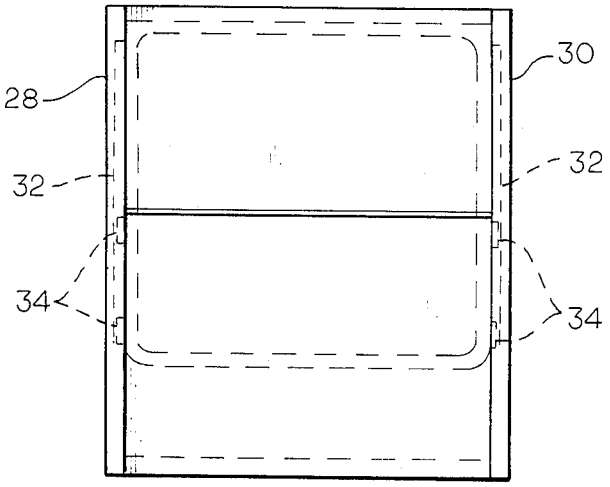
FIG. 4 is a front elevational view of the solid deodorant dispensing package of FIGS. 1, 2, and 3.
Figure 5:
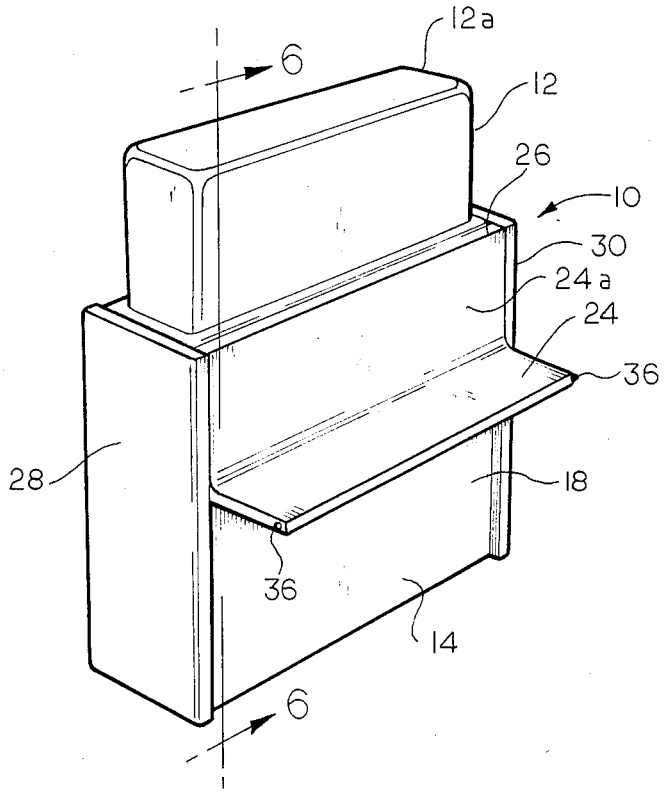
FIG. 5 is a perspective view of the solid deodorant dispensing package of FIGS. 1 through 4 in its opened, dispensing position.
Figure 7:
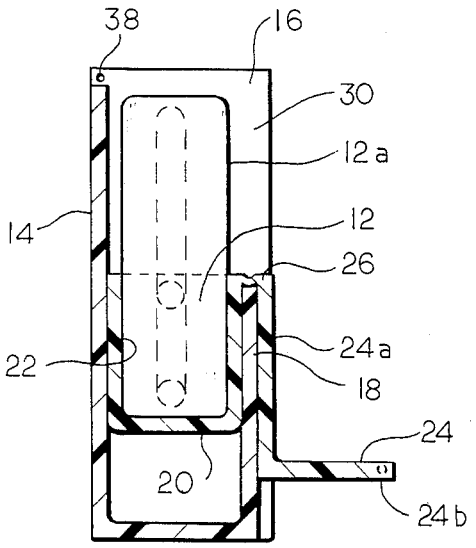
FIG. 7 is a view similar to FIG. 6 showing the solid deodorant dispensing package after the package has been opened, but before the solid deodorant therein has been advanced to its dispensing position.
Figure 6:
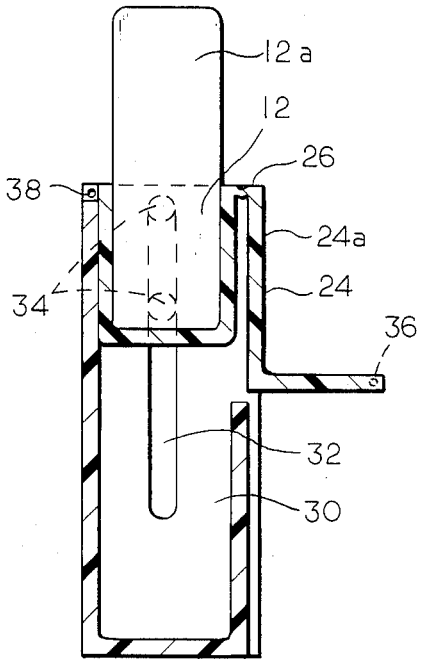
FIG. 6 is a sectional view taken on line 6—6 of FIG. 5.

The preferred embodiment of a solid deodorant dispensing package according to the present invention is shown in FIG. 1 in its normal storage or non-dispensing position, and is generally identified by reference numeral 10. As is shown in FIG. 5, the package 10 contains a solid deodorant 12 in the form of a cake, or generally in the shape of a parallelepiped. The package 10 also includes a hollow container 14 whose interior cavity corresponds in a shape to the shape of the solid deodorant 12. The solid deodorant 12 can be raised or lowered with respect to the container 14 as hereinafter described, to be retracted entirely within the outline of the container 14, as is shown in FIG. 1, or to present a portion **12*a* of the solid deodorant 12 in a dispensing or use position beyond the outline of the container 14, as is shown in FIGS. 5 and 6. The container 14 is open along one of its six sides, shown as the side 16 at the upper portion of the container 14, the opening of the container 14 at the side 16 serving as the opening through which the solid deodorant 12 can be dispensed. Further, the container 14 has a partial depth opening extending from the dispensing opening in the side 16 in a side 18 that intersects the side 16, to permit an L-shaped closure 24 of a combined member 20, the free end of one of whose legs 24*a* is foldably attached to the edge of a holding cup 22 element of the combined member 20 that is adjacent to the side 16, to be folded 180° with respect to the holding cup 22 through the opening in the side 18. By such folding of the L-shaped closure 24, the leg 24*a* thereof that is foldably attached to the holding cup 22 is folded from a position in which it extends upwardly from the holding cup 22 to a position in which it extends downwardly therefrom, on the outside of the side 18, and the other leg 24*b* of the L-shaped member is folded from a position in which it extends across the dispensing opening in the side 16, in closing relationship therewith, to a position in which it extends outwardly from the package 10, as is shown in FIG. 7. When the leg 24***b* is in the position shown in FIG. 7, it may be manually grasped to permit a user to raise the holding cup 22 and the solid deodorant 12 from the storage position shown in FIG. 7 to the use position shown in FIG. 6, and thereafter back to the FIG. 7 storage position prior to a reclosing of the package 10 by a reversal of the folding of the closure 24 back through 180° to the position shown in FIGS. 1 through 4.

The movement of the holding cup 22 in the container 14 is facilitated by providing partial depth guide grooves 32 on the inside of opposed sides 28 and 30 of the container 14, the guide grooves 32 extending parallel to the path of travel of the holding cup 22 within the container 14 toward and away from the dispensing opening in the side 16, and by providing the opposed sides of the holding cup 22 which are adjacent to the sides 28 and 30 of the container 14 with outwardly projecting pins 34 to extend into the guide grooves 32. The leg 24*b* of the L-shaped closure 24 is provided with outwardly projecting tabs 36 which are received in recesses 38 in the sides 28 and 30 of the container 14 when the closure is in its FIGS. 1 through 4 closing position to provide for a secure snap fit between the closure 24 of the combined member 20 and the container 14.

Figure 9:
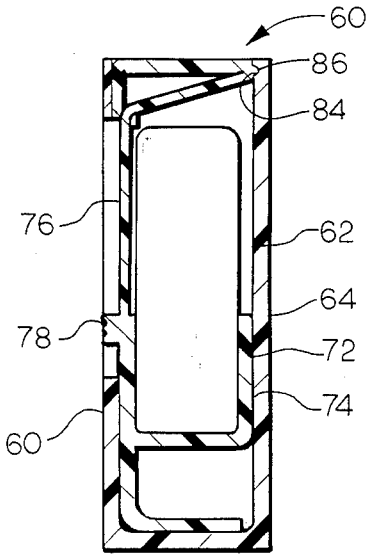
FIG. 9 is a sectional view taken on line 9—9 of FIG. 8.
Figure 8:
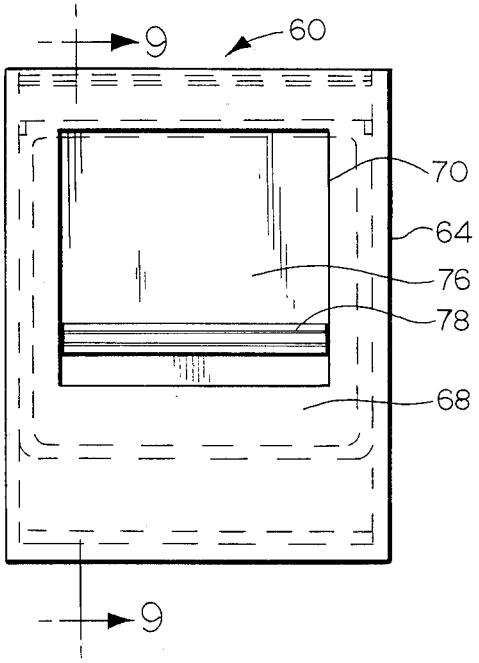
FIG. 8 is a front elevational view of a solid deodorant dispensing package according to an alternative embodiment of the present invention.
Figure 10:
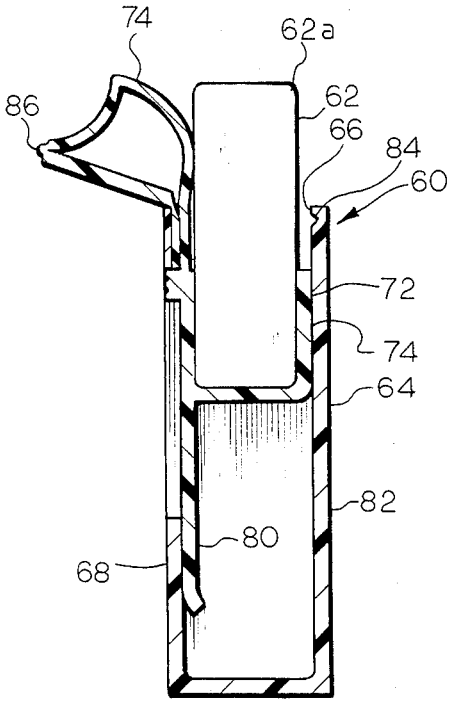
FIG. 10 is a view similar to FIG. 9 showing the solid deodorant dispensing package of FIGS. 8 and 9 after the package has been opened to present a portion of the solid deodorant for use.
Figure 11:
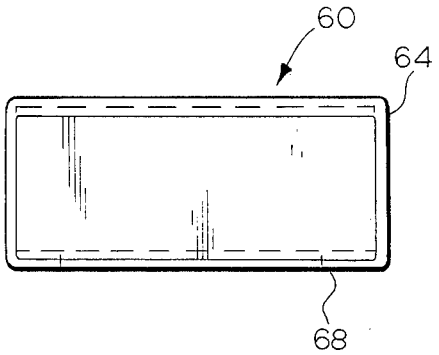
FIG. 11 is a top plan view of the solid deodorant dispensing package as illustrated in FIG. 8 and 9.

In the embodiment of the invention illustrated in FIGS. 8 through 11, there is provided a package, which is generally indicated by reference numeral 60, that includes a solid deodorant 62 of generally parallelepiped-shape which is contained within the cavity of a generally parallelepiped-shaped container 64. The container 64 is open along one of its six sides, identified by reference numeral 66, which forms a dispensing opening through which a portion 62*a* of the solid deodorant 62 can be advanced for dispensing or use, as is shown in FIG. 10. A side 68 of the container 64, a side which extends normally with respect to the dispensing opening of the container through the side 66 and generally parallel to the path of travel of the solid deodorant 62 within the container 64, is provided with an opening 70 adjacent the dispensing opening in the side 66 of the container 64.

The package 60 of the embodiment of the invention illustrated in FIGS. 8 through 11 also includes a combined member 72 which is positioned within the cavity of the container 64 and which includes a holding cup 74 and a flexible extension 76 that extends upwardly from an edge of the holding cup 74 to form a closure for the package 60 when the holding cup 74 has been retracted within the container 64 so that the solid deodorant 62 is entirely within the container 64, as shown in FIG. 9. The flexible extension 76 has a rib of 78 which projects outwardly therefrom through the opening 70 in the side 68 of the container 64, to permit the holding cup 74 of the combined member 72 to be raised and lowered within the container 64 to thereby selectively position the solid deodorant 62 so that the portion 62*a* thereof is located externally of the container 64 for dispensing or use, as shown in FIG. 10, or is positioned entirely within the container 64 for storage, as is shown in FIG. 9. Because the dispensing position of the portion 62*a* of the solid deodorant 62 is sufficiently high to require that the bottom of the holding cup 74 of the combined member 72 be above the bottom of the opening 70 in the side 68 of the container 64, the combined member 72 has a flexible extension 80 extending from the underside of the holding cup 74 and located adjacent to the side 68 of the container 64. The flexible extension 80, which is formed integrally with the combined member 72, has sufficient flexibility to permit it to be turned in when the combined member 72 is retracted within the container 64, as is shown in FIG. 9, and sufficient elasticity to return to a position extending generally parallel to the side 68 of the container 64 when the combined member 72 is advanced within the container 64 to present the portion 62*a* of the solid deodorant 62 at a dispensing position, so that the flexible extension 80 will cover the portion of the opening 70 in the side 68 which would otherwise be exposed by the underside of the holding cup 74. Further, the flexible extension 80 has a width, extending across the face of the side 68, which is greater than the width of the opening 70, and which, preferably, is approximately as great as the width of the sides of the container 64 that extend from the opposed ends of the side 68. Thus, the flexible extension 80 also serves to guide the advance and retraction of the combined member 72 within the cavity of the container 64.

The free end of the flexible extension 76 of the combined member 72 is adhesively bonded or otherwise secured to the side 68 of the container 64, above the location of the opening 70 in the side 68. Thus, as the combined member 72 is advanced toward the opening 66 in the container 64, the flexible extension 76 will be required to fold back upon itself, as is shown in FIG. 10, to provide a self-opening closure for the package 60. Conversely, when the combined member 72 is retracted back into the container 64, as is shown in FIG. 9, the flexible extension 76 will be drawn back toward a position closing the side 66 of the container 64, to provide a self-closing feature for the package 60. Preferably, the side 82 of the container 64 which is opposed to the side 68 has a recess 84 therein adjacent the side 66 of the container 64, and the recess 84 receives a projecting portion 86 of the flexible extension 76 of the combined member 72 when the combined member 72 is retracted back into the cavity in the container 64, to thereby form snap-lock fit between the combined member 72 and the container 64 when the container 64 is fully closed.

The combined member 20 of the embodiment of FIGS. 1–6 and the combined member 72 of the embodiment of FIGS. 7–11 may each be formed in a single piece from a suitable thermoplastic material by injection molding. Suitable thermoplastic materials for this purpose include high density polyethylene and flexible modifications thereof, polypropylene and flexible modifications thereof and flexible forms of polystyrene such as butadiene modifications of polystyrene. The container 14 of the embodiment of FIGS. 1–6 and the container 60 of the embodiment of FIGS. 7–9 may each be formed in a single piece from a suitable thermoplastic material by injection molding. Suitable thermoplastic materials for this purpose include high density polyethylene, polypropylene and polystyrene and modifications of such materials which need not be flexible. If desired, the combined member 20 or 72 of the package 10 or 60 may be a different color than the container 14 or 64 of such package 10 or 60, for example green and white, respectively, for aesthetic reasons.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A solid deodorant dispensing package comprising:

a six-sided container having wall means defining a generally parallelepiped-shaped cavity with a dispensing opening along one of the sides of the container;

a cup for holding a solid deodorant positioned within said cavity of said container, said cup being moveable toward and away from said dispensing opening between a dispensing position that is adjacent to said dispensing opening and a storage position that is away from said dispensing opening;

a solid deodorant having a first portion that is contained within said cup and a second portion that extends away from said cup, at least a portion of said second portion extending through said dispensing opening when said cup is in said dispensing position, said at least a portion of said second portion being contained within said cavity when said cup is in said storage position; and closure means foldably attached to said cup and being foldable with respect to said cup for closing said dispensing opening when said cup is in said storage position.

2. A solid deodorant dispensing package according to claim 1 wherein said cup and said closure means are formed integrally with one another in a single piece.

3. A solid deodorant dispensing package according to claim 2 wherein said cup and said closure means are formed integrally with one another from a thermoplastic material by injection molding.

4. A solid deodorant dispensing package according to claim 3 wherein said thermoplastic material is selected from the group consisting of high density polyethylene polypropylene, modifications of high density polyethylene, modifications of polypropylene and butadiene modifications of polystyrene.

5. A solid deodorant dispensing package according to claim 3 wherein six-sided container is formed in a single piece from a second thermoplastic material by injection molding and wherein said second thermoplastic material is selected from the group consisting of high density polyethylene, modifications of high density polyethylene, polypropylene, modifications of polypropylene, polystyrene and modifications of polystyrene.

6. A solid deodorant dispensing package comprising:

a six-sided container having wall means defining a generally parallelepiped-shaped cavity with a dispensing opening along one of the sides of said container and a partial depth opening that is in communication with said dispensing opening in another one of the sides of the container, said another one of the sides of the container intersecting said one of the sides of the container;

a cup for holding a solid deodorant positioned within said cavity of said container, said cup having a side that is adjacent said another one of the sides of the container and being moveable toward and away from said dispensing opening between a dispensing position that is adjacent to said dispensing opening and a storage position that is away from said dispensing opening;

a solid deodorant having a first portion that is contained within said cup and a second portion that extends away from said cup, at least a portion of said second portion extending through said dispensing opening when said cup is in said dispensing position, said at least a portion of said second portion being contained within said cavity when said cup is in said storage position; and an L-shaped closure having a first leg with a first free end and a second leg with a second free end, one of said first free end and said second free end being foldably attached to said cup along said side, said L-shaped closure being foldable with respect to said cup from a first position in which said first leg extends from and in longitudinal alignment with said side of said cup and said second leg extends across said dispensing opening of said container to close said dispensing opening to a second position in which said second leg extends outwardly from said container, whereby said second leg, when said L-shaped closure is in said second position, may be grasped to permit said cup to be moved between said dispensing position and said storage position.

7. A solid deodorant dispensing package according to claim 6 wherein said cup and said L-shaped closure are formed integrally with one another.

8. A solid deodorant dispensing package according to claim 3 wherein said cup and said L-shaped closure are formed integrally with one another from a thermoplastic material by injection molding.

9. A solid deodorant dispensing package according to claim 8 wherein said thermoplastic material is selected from the group consisting of high density polyethylene, polypropylene, modifications of high density polyethylene, modifications of polypropylene and butadiene modifications of polystyrene.

10. A solid deodorant dispensing package according to claim 8 wherein said six-sided container is formed in a single piece from a second thermoplastic material by injection molding.

11. A solid deodorant dispensing package according to claim 10 wherein said thermoplastic material has a first color, wherein said second thermoplastic material has a second color and wherein said second color is different than said first color and is harmonious with said first color.

12. A solid deodorant dispensing package according to claim 10 wherein said second thermoplastic material is selected from the group consisting of high density polyethylene, polypropylene, polystyrene, modifications of high density polyethylene, modifications of polypropylene and modifications of polystyrene.

13. A solid deodorant dispensing package according to claim 6 wherein said L-shaped closure is foldable with respect to said cup through an arc which is not substantially less than 180°, the folding of said L-shaped closure with respect to said cup causing said first leg to pass arcuately through said partial depth opening in said another one of the sides of the container.

14. A solid deodorant dispensing package comprising:

a six-sided container having wall means defining a generally parallelepiped-shaped cavity having a dispensing opening along one of the sides of the container and an opening within another one of the sides of the container intersecting said one of the sides of the container;

a cup for holding a solid deodorant positioned within said cavity of said container, said cup having a side that is adjacent said another one of the sides of the container and being moveable toward and away from said dispensing opening between a dispensing position that is adjacent to said dispensing opening and a storage position that is away from said dispensing opening, said cup further having engageable means projecting from said side, said engageable means being engageable through said opening within said another one of the sides of the container whereby said cup may be moved between said dispensing position and said storage position;

a solid deodorant having a first portion that is contained within said cup and a second portion that extends away from said cup, at least a portion of said second portion extending through said dispensing opening when said cup is in said dispensing position, said at least a portion of said second portion being contained within said cavity when said cup is in said storage position; and flexible closure means having a first end that is foldably attached to said cup along said side, a second end that is foldably attached to said another one of the sides of the container, and a portion between said first end and said second end that extends across said dispensing opening in a closing position with respect to said dispensing opening when said cup is in said storage position, said portion being moved by the movement of said holding cup to a non-closing position with respect to said dispensing opening as said holding cup moves toward said dispensing position.

15. A solid deodorant dispensing package according to claim 14 wherein said cup and said flexible closure means are formed integrally with one another in a single piece.

16. A solid deodorant dispensing package according to claim 15 wherein said cup and said flexible closure means are formed integrally with one another from a thermoplastic material by injection molding.

17. A solid deodorant dispensing package according to claim 17 wherein said thermoplastic material is selected from the group consisting of high density polyethylene, polypropylene, modifications of high density polyethylene, modifications of polypropylene, and butadiene modifications of polystyrene.

18. A solid deodorant dispensing package according to claim 16 wherein said six-sided container is formed in a single piece from a second thermoplastic material by injection molding.

19. A solid deodorant dispensing package according to claim 18 wherein said thermoplastic material has a first color, wherein said second thermoplastic material has a second color and wherein said second color is different than said first color and is harmonious with said first color.

20. A solid deodorant dispensing package according to claim 14 wherein said opening within said another one of the sides of the container has a bottom, wherein said cup has a bottom, wherein said bottom of said cup is above said bottom of said opening within said another one of the sides of the container when said cup is in said storage position, and further comprising:

flexible tail means attached to said bottom of said cup along said side of said cup, said flexible tail means closing said opening within said another one of the sides of said container when said cup is in said closing position.

21. A solid deodorant dispensing package according to claim 20 wherein said cup and said flexible tail means are formed integrally with one another in a single piece.

* * * * *